United States Patent [19]

Craig

[11] 4,113,916

[45] Sep. 12, 1978

[54] SHELL SAND WITH IMPROVED THERMAL SHOCK RESISTANCE

[75] Inventor: Robert Simpson Craig, Hoffman Estates, Ill.

[73] Assignee: Acme Resin Corporation, Forest Park, Ill.

[21] Appl. No.: 694,426

[22] Filed: Jun. 9, 1976

Related U.S. Application Data

[63] Continuation of Ser. No. 510,088, Sep. 27, 1974, abandoned.

[51] Int. Cl.[2] ..... B32B 5/16

[52] U.S. Cl. ..... 428/404; 428/407

[58] Field of Search ..... 428/404, 407

[56] References Cited

U.S. PATENT DOCUMENTS

| | | | |
|---|---|---|---|
| 3,838,095 | 9/1974 | Johnson | 428/404 |
| 3,860,561 | 1/1975 | Vargiu | 428/404 |

*Primary Examiner*—Marion E. McCamish

[57] ABSTRACT

A resin coated sand comprising:

(a) particles of sand coated with from about 1% to about 8% by weight sand of phenol-formaldehyde morolak resin;

(b) a curing agent; and (c) from about 2% to about 50% by weight of phenol-formaldehyde morolak resin of an epoxy and/or phenoxy resin.

The resin coated sands of the present invention provide improved thermal shock resistance without creating smoke and odor problems. In addition, the resin coated sands of the invention can be formed into foundry articles that possess good tensile strength.

11 Claims, No Drawings

SHELL SAND WITH IMPROVED THERMAL SHOCK RESISTANCE

This is a continuation, of copending application Ser. No. 510,088, filed Sept. 27, 1974, now abandoned.

BACKGROUND OF THE INVENTION (a) Statement of the Invention

The present invention relates to novel resin coated sands which contain epoxy and/or phenoxy resins with potentially thermosetting phenol-formaldehyde novolak resins which have improved thermal shock resistance without creating smoke and odor problems.

(b) Description of the Prior Art

Thermal shock resistance has been a problem with Shell Molds and Cores for many years. Thermal shock is the term used to describe the tendency of a Shell Mold or Core to crack when metal is poured against it. If a minor crack occurs, the metal will penetrate the crack and create a vein or fin on the casting surface. Grinding off these fins or veins adds to the finishing cost of castings. If a major crack occurs on pouring metal, the hot metal may run out of the mold onto the floor. This causes a serious safety problem and wastes production time and money. Reduction of thermal shock problems is obviously an important objective.

Considerable effort has been made over the years to improve thermal shock resistance. The usual approaches are to either change the type of sand used or put additives into the resin coated sand mix. Angular shaped silica sands such as lake sands and bank sands are less prone to cracking (thermal shock) than round grain sands. Special sands such as zircon, aluminum silicate, olivine and chromite sands are sometimes used in place of silica because they have greater thermal shock resistance. They are much more expensive than silica sand and, therefore, it is desirable to find ways of using silica sand.

A variety of additives have been used with silica sand to improve its thermal shock resistance. Inorganic materials such as from oxide and clay are helpful in some situations. An organic additive known as Vinsol, is probably the most widely used additive. It is effective in reducing or eliminating thermal shock problems and does not adversely affect tensile strengths of the resin coated sand. The inorganic additives can greatly reduce tensiles. The use of Vinsol in resin coated sand is described in U.S. Pat. No. 2,751,650. Vinsol acts as a reactive plasticizer to make the cores and molds less brittle and thus more resistant to thermal shock.

The main deficiencies of Vinsol are that it gives off a great deal of smoke and odor when Shell cores and/or molds are made, and also when metal is poured against the cores and/or molds. With increasingly tight air pollution laws and OSHA laws, discontinuing the use of Vinsol has become important. Discovery of an organic material which can be incorporated into resin coated sand which gives thermal shock resistance without creating smoke or odor problems is a sought after objective by those workers in the art of preparing resin coated sands.

SUMMARY OF THE INVENTION

The present invention relates to a resin coated sand comprising:

(a) particles of sand coated with from about 1% to about 8% by weight of the sand, of a phenol-formaldehyde novolak resin;

(b) a curing agent; and (c) from about 2% to about 50%, by weight of the phenol-formaldehyde novolak resin of an epoxy and/or phenoxy resin.

The present invention also relates to a process for forming foundry cores and molds comprising the steps of:

(1) contacting a hot pattern with a free-flowing resin coated sand comprising;

(a) particles of sand coated from about 1% to about 8% by weight of the sand, of a phenol-formaldehyde novolak resin;

(b) a curing agent;

(c) from about 2 to about 50%, by weight of the phenol-formaldehyde novolak resin, of an epoxy and/or phenoxy resin;

(2) holding the resin coated sand against the hot pattern to bond a portion of the particles of resin coated sand together to form a foundry mold or core of suitable thickness;

(3) removing unbonded particles of resin coated sand from bonded particles of sand forming the foundry mold or core;

(4) curing the foundry mold or core at a temperature in the range of from about 175° C. to about 320° C., and preferably at a temperature in the range of from about 200° C. to about 290° C., and (5) removing the foundry mold or core from the pattern.

As it will be explained hereinafter, the present invention involves the discovery that the incorporation of a small amount of epoxy and/or phenoxy resin into the resin coated sand, provides good thermal shock resistance. In addition, the present invention provides for a novel composition whereby odor and smoke levels are the same as if no additive was present and are substantially less than when Vinsol is present in a comparable type of resin composition. In other words, it has been discovered that by incorporating epoxy and/or phenoxy resins into sand coated with potentially thermosetting phenol-formaldehyde novolak resins, improved thermal shock resistance resin coated sands are provided which do not create smoke and odor problems. In addition, good tensile strengths are maintained utilizing the resin coated sands of the present invention.

DESCRIPTION OF THE PREFERRED EMBODIMENTS

Phenolic resins are known to be particularly useful in the Shell molding process. For Shell molding, two-step phenol-formaldehyde resins (also known as novolaks) which are potentially thermosetting are employed. Thermoplastic phenol-formaldehyde novolak resins can be made potentially thermosetting by incorporating a curing agent such as hexamethylene-tetramine. (Useful examples of potentially thermosetting phenolic resin coated sands are disclosed in U.S. Pat. Nos. 2,706,163 and 2,888,418, the disclosures of which are incorporated herein by reference).

A resin coated sand useful in the practice of the present invention is disclosed in application U.S. Ser. No. 288,605, filed Sept. 13, 1972, now U.S. Pat. No. 3,838,095, granted Sept. 24, 1974, the disclosure of which is incorporated herein by reference. This patent discloses and claims sands coated with a phenol-formaldehyde novolak resin, a curing agent and a urea type composition.

Foundry cores can also be formed in ether processes which can employ one-step phenol-formaldehyde resins (also known as resoles). Such processes employing one-step resins which are modified with urea have been disclosed. (See, for example, U.S. Pat. Nos. 3,306,864 and 3,404,198, the disclosures of which are incorporated herein by reference). In addition, U.S. Pat. No. 3,215,585 discloses employing urea with phenol-formaldehyde resin for use in the glass fiber art. The one-step resins, however, are not generally useful in the Shell process.

Preferred resin coated sands especially useful in the practice of the present invention, are particles of sand, separate from adjacent particles, coated with from about 1 to about 6% by weight of a resin comprising a two-step (novolak) phenol-formaldehyde resin. While the coating resin can be either a liquid or a solid, the coating resin is preferably solid.

Methods for forming these preferred free-flowing resin coated sands are well known in the art, and such methods can be generally followed in the practice of the present invention. A suitable phenol-formaldehyde novolak resin composition for use in the practice of the present invention comprises an acid catalyzed phenol-formaldehyde resin formed by reacting phenol and formaldehyde in a molar ratio of from about 0.5 to about 0.85 mole of formaldehyde to mole of phenol in the presence of an acid catalyst, such as, for example, from about 0.4 to about 0.8% of hydrochloric acid by weight of the phenol, or more when employing acids such as sulfuric or oxalic acids. Substituted phenols such as o-cresol, t-butyl phenol, etc. may be used in combination with phenol. The phenolic resin polymer formed in the process is conveniently brought to the desired stage of polymerization by heating the reactants, preferably at a temperature from about 35° C. to about 100° C., after which the acid is neutralized. Water in the resulting reaction mixture can be removed to form a concentrated liquid resin product suitable for use in forming resin coated sand, or sufficient water can be removed such that the resin is a solid at room temperature (25° C.). The solid resin can be ground to a powder or flaked and the resulting resin solids can be used to form a preferred resin coated sand of the present invention.

Generally, the process of coating sand with resin involves placing the sand in any one of several types of mixers commonly used in foundry work. Examples of these are: the Beardsley-Piper speed muller and the Simpson muller. To this sand is added from about 1 to about 8%, preferably 1 to about 6%, by weight of sand, or the resin, and a suitable amount of curing agent, for example, hexamethylenetetramine to render the novolak resin potentially thermosetting. An amount of curing agent suitable for rendering the resin thermosetting is from about 8 to about 20% by weight of the resin. The components are heated to a suitable mixing temperature and mixed to coat each of the sand grains with a layer of the resin and curing agent. After the sand is coated with resin, the coated sand is cooled to room temperature, as for example by quenching with water. The mixing is continued for a sufficient time to obtain a free-flowing product.

In the practice of the present invention, from about 2 to about 50%, preferably from about 5 to about 25%, by weight of the phenol-formaldehyde novolak resin of an epoxy or phenoxy compound is incorporated into the resin coated sand. It has been suprisingly found that by incorporating epoxy and/or phenoxy resins in the resin coated sand, there is provided coated sands having improved thermal shock resistance. Also, these coated sands have less odor and smoke on core making or metal pouring than Vinsol containing resin coated sands.

The epoxy and/or phenoxy resin can be incorporated into the resin coated sand in a variety of ways. For example, the epoxy and/or phenoxy resin can be dispersed or dissolved in the phenol-formaldehyde resin prior to adding the resin to the sand. Alternately, these resins can be added directly to the sand during the coating process. In this case it is desirable to add the said resins at approximately the same time the phenol-formaldehyde novolak resin is added, although they may be added to the sand before or after the novolak.

It has been unexpectedly discovered that the epoxy resin additives appear to be even more effective on thermal shock resistance than the additive Vinsol. For example, it has been found that by incorporating from about 5 to about 7% by weight of an epoxy based upon the amount of the novolak resin, in a resin provided as good if not better thermal shock resistance as 14 to 15% of Vinsol, by weight, based upon the weight of the resin in a novolak resin system. All of the other varables in the coated sand were kept constant.

Epoxy resins suitable in the practice of the present invention, include those resins commercially available under the trade names; Epon 828, Epon 1001, Epon 1002, Epon 1004, etc., available from the Shell Chemical Company. Other commercial producers of similar epoxy resins suitable in the practice of the invention are available from Ciba-Geigy, Dow Chemical Company, and Celanese. The epoxy resins may be used in the form of a liquid or a solid. These commercially available epoxy resins are generally prepared by reacting or contacting an excess amount of a epichlorohydrin with Bisphenol A. These resins are characterized by the terminal reactive oxirane ring which can be reacted with curing agents, or catalytically homopolymerized to form a cross-linked polymeric structure. Their most outstanding property is their excellent adhesion which is due in part to the secondary hydroxyl group located along the molecular chain. Specifically, the epoxy resins are manufactured by reacting epichlorohydrin and Bisphenol A in the presence of aqueous caustic soda. The reaction is always carried out with an excess of epichlorohydrin so that the resulting resin has terminal epoxy groups. Thus, by varying manufacturing conditions, and the excess of epichlorohydrin, resins of low, intermediate or high molecular weight may be produced. In the manufacture of the epoxy resins, the larger amounts of epichlorohydrin lowers the molecular weight of the final resin products. On the other hand, the molecular weight epoxy resins can be manufactured by decreasing the amount of epichlorohydrin providing, of course, that the epichlorohydrin is used in a molar excess to the Bisphenol A.

Other classes of epoxy resins may also be used in the practice of the present invention. For example, the epoxy novolak resins, such as those available commercially under the trade names EPN 1138, EPN 1139 available from the Ciba-Geigy Corporation may be used alone or in combination with the epoxy resins based on Bisphenol A. Also, cyclic aliphatic epoxy resins and other types of epoxy resins may be used in the practice of the present invention.

The preferred epoxy resins are solid or liquid resins produced by the reaction of Bisphenol A and epichlorohydrin.

The phenoxy polymers are also effective in providing thermal shock resistance to the resin coated sands of the present invention. The phenoxy polymers are also prepared by reacting Bisphenol A with epichlorohydrin, however, in the case of the phenoxy resins, an equal molar amount or an excess of Bisphenol A is used in the process. Even though the basic chemical structure of the epoxy and phenoxy resins are similar, they are, however, separate and unique resin compositions, different from one another in several important characteristics. For example, the phenoxy resins are tough and ductile thermoplastics. Their molecular weight is generally about 30,000 compared to 340 to 5,000 for conventional epoxy resins. The phenoxy resins do not have terminal highly reactive epoxy groups and are thermally stable materials with a long shelve life. Moreover, phenoxy resins can be used as adhesives and coatings without further chemical conversion and they do not require catalysis, curing agents, or harders to be useful products. High molecular weight phenoxy resins are available commercially from Union Carbide Corporation under the trademark Bakelite phenoxy resins.

It is often the practice in the foundry art to include a variety of adjuvants in the resin coated sands, such as for example, waxy compounds such as calcium stearate and bis-stearoxylamide of ethylenediamine, salicylic acid, clay, iron oxide and ligin-type resins. Such adjuvants can also be especially useful in the resin coated sands of the present invention.

The invention is further illustrated by the following examples, which, however, are not to be taken as limiting in any respect. All parts and percentages, unless expressly stated to be otherwise, are by weight.

EXAMPLE 1

A phenol-formaldehyde novolak resin is formed in the following manner. A charge of 30,000 parts by weight of phenol and 400 parts of sulfamic acid is placed in a reactor. The temperature is raised to 100° C., and 19,440 parts of aqueous 37% by weight formaldehyde are added slowly to the mixture. After the formaldehyde is completely added, the resulting mixture is refluxed for three hours to form a phenolic resin. The resulting resin is dehydrated to remove water and then heated to 135° C. under 25 inches of vacuum to completely remove all traces of water. To the resin there is added 1,750 parts by weight of bis-stea oxylamide of ethylenediamine. The resin is converted to a flake by passing it through a roll mill equipped with cooled stainless steel rollers. This resin is the unmodified control Resin A.

Similar resins were made and blended with Vinsol (Resin B) and Epoxy Resin (Resin C) for comparison purposes. The Vinsol containing resin (Resin B) is prepared the same as Resin A except that 5,400 parts of Vinsol are added immediately after the bis-stearoxylamide of ethylenediamine is added.

The epoxy containing resin (Resin C) is prepared the same as Resin A except that 1,850 parts of Ciba-Geigy Araldite 7097 solid epoxy resin, epoxy equivalent weight 1650–2000, was added immediately after the bis-stearoxylamide of ethylenediamine is added.

A series of resin coated sands designated as coated sands A, B and C were prepared in the following manner. A quantity of Wedron 7020 foundry sand was heated to 130° C. and added to a Simpson Porto Muller. A quantity of the above flake resin product was added to the muller and the mixture of resin and sand mulled for 90 seconds to melt the flake and coat it onto the sand. Then a solution comprising a quantity of hexamethylene-tetramine in water was added to the muller. Mulling was continued until the mixture broke up into free flowing grains of resin coated sands. The coated sand was then discharged from the muller. The quantities involved in the formulation of each of the coated sands are given in Table I.

TABLE I

| Coated Sand A | | Coated Sand B | | Coated Sand C | |
|---|---|---|---|---|---|
| Resin A | 1331 gm. | Resin B | 1331 gm. | Resin C | 1331 gm. |
| Sand | 100 lbs. | Sand | 100 lbs. | Sand | 100 lbs. |
| Hexa* | 192 gm. | Hexa* | 192 gm. | Hexa* | 192 gms. |
| Water | 800 ml. | Water | 800 ml. | Water | 800 ml. |

*Hexamethylenetetramine

Resin coated sand C is an example of this invention, whereas sands A and B are presented for comparison purposes.

Cold tensile and hot tensile of each of the coated sands were determined as follows:

The hot tensile strengths were determined by use of a Dietert No. 365 Hot Shell Tensile Tester. Tests were run a 232° C. with a 3 minute cure time.

The cold tensiles were determined by making ¼ inch thick dog bone test briguets in a Dietert No. 363A Heated Shell Curing Accessory. The test briquets were cured for 3 minutes at 232° C. and allowed to cool to room temperature. The cold tensile of the briquets was then determined by using a 401 Universal Sand Strength Tester in the manner set forth by the American Foundryman's Society. Odor and smoke comparisions were made by the sense of smell and visual observations.

The results are as follows:

| Coated Sand | A | B | C |
|---|---|---|---|
| Cold Tensile (PSI) | 515 | 650 | 647 |
| Hot Tensile (PSI) | 430 | 433 | 424 |
| Smoke | slight | Considerable | slight |
| Odor | normal shell sand | strong Vinsol odor | normal shell sand odor |

These results clearly show that the epoxy modified coated sand C has tensiles similar to the control sand A and the vinsol modified sand B. Odor and smoke levels are equivalent to the unmodified sand A and much lower than the vinsol modified sand B.

METAL CASTING RESULTS

Resin coated sand was prepared as described above using resins B and C, using this formulation: St. Marie bank sand 100 parts, Resin B or Resin C 4 parts, Hexamethylenetetramine 0.6 parts and water 1.0 parts. Shell molds were made and then stainless steel metal was poured into the molds. The following observations were made.

Mold Making — Much less smoke and odor observed using sand coated with Resin C compared to Resin B.

Metal Pouring — Much less smoke and odor observed when pouring metal into molds made from sand coated with Resin C than sand coated with Resin B.

Inspection of the cooled castings gave these results:

Sand coated Resin B — slight veining

Sand coated Resin C — no veining

These metal casting results indicate that the epoxy additive is more effective in holding metal and reducing thermal shock than vinsol.

This example describes the use of a phenoxy resin in the resin coated sands of the present invention.

The phenoxy modified shell resin was prepared the same as Resin A of Example 1, except that 1,850 parts of Phenoxy polymer PLC-700 (manufactured by Union Carbide Corporation) was added immediately after the bis-stearoylamide of ethylenediamine was added. This resin was coated onto Wedron 7020 foundry sand using the coating process of Example 1, except a Hobart Mixer was used to mix or mull the sand during the coating process. Resin A of Example I was similarly coated for comparison purposes.

| Example II-Coated Sand | | Central-Coated Sand | |
|---|---|---|---|
| | Parts | | Parts |
| Resin Example 2 | 30 | Resin A of Example 1 | 30 |
| Sand | 1000 | Sand | 1000 |
| Hexamethylene-tetramine | 4.2 | Hexamethylene-tetramine | 4.2 |
| Water | 1 | Water | 1 |

Cold tensile and hot tensile properities were determined on each of the coated sands.

| Example II-Coated Sand | | Control-Coated Sand |
|---|---|---|
| Cold Tensile (PSI) | 512 | 500 |
| Hot Tensile (PSI) | 380 | 375 |

These results clearly show that the phenoxy modified coated sands of the present invention have tensiles equivalent to the unmodified control. Odor and smoke levels were equivalent to the unmodified control coated sand. Thus, the phenoxy-containing resins represent a significant improvement over the Vinsol containing resins from the standpoint of pollution.

EXAMPLE 3

This example demonstrates that the epoxy and/or phenoxy resins can be added directly to the muller or mixer during the coating process as well as preblended with the phenolic shell resins as illustrated in Examples 1 and 2.

Two coated sands were prepared as described in Example 1, except a Hobart mixer was used to mull the sand in place of the Simpson muller. Coated sand using premixed epoxy and phenolic shell resin was prepared using Resin C of Example 1.

Coated sands made by separately adding the epoxy resin and the unmodified phenolic resin to the sand during the coating process were made with the formulation shown below. The epoxy resin and phenolic resins were both added separately at the start of the 90 second wet mull.

| Premixed Epoxy and Phenolic Resin | | Separate Additions of Epoxy and Phenolic Resins | |
|---|---|---|---|
| | Parts | | Parts |
| Sand | 1000 | Sand | 1000 |
| Resin C (Example 1) | 30 | Resin A (Example 1) | 28.5 |
| Hexamethylene-tetramine | 4.2 | Araldite 7097 | 1.5 |
| | | Epoxy Hexamethylene-tetramine | 4.2 |
| Water | 11.0 | Water | 11 |

-continued

Tensiles were compared to show that similar results were obtained by either method of introducing the epoxy resin into the coated sand.

| Premixed Epoxy and Phenolic Resin | | Separate Additions of Epoxy and Phenolic Resins |
|---|---|---|
| Cold Tensile (PSI) | 393 | 390 |
| Hot Tensile (PSI) | 300 | 273 |

The above data further demonstrates that the use of epoxy and/or phenoxy resins in novolak resin coated sands possess good tensile strengths without the deleterious effect of smoke and odor.

While not wishing to be bound to any theory, it is believed that the epoxy and/or phenoxy resins act as reactive plasticizers in the novolak resin coated sands. This would account for the good tensile strengths of the final resin coated sands of the invention. Thus, the resin coated sands enjoy the tensile strength properties possessed by those containing Vinsol, but do not suffer the disadvantage of producing smoke and odor.

While the invention has been described in connection with specific embodiments thereof, it will be understood that it is capable of further modification, and this application is intended to cover any variations, uses, or adaptions of the invention following, in general, the principles of the invention and including such departures from the present disclosure as come within known or customary practice in the art to which the invention pertains and as may be applied to the essential features hereinbefore set forth, as fall within the scope of the invention.

What is claimed is:

1. A resin coated sand comprising:

(a) particles of sand coated with from about 1 to about 8% by weight of the sand, of a phenol-formaldehyde novolak resin;

(b) a curing agent; and (c) from about 2 to about 50%, based upon the weight of the phenol-formaldehyde novolak resin, of an epoxy and/or phenoxy resin.

2. The resin coated sand of claim 1, wherein said epoxy and/or phenoxy resin is present in amounts ranging from about 5 to about 25% based on the weight of the phenol-formaldehyde novolak resin.

3. The resin coated sand of claim 1, wherein the phenol-formaldehyde novolak resin is present in amounts ranging from about 1 to about 6% by weight based on the sand.

4. The resin coated sand in accordance with claim 1, wherein an epoxy resin is employed in the composition.

5. The resin coated sand of claim 4, wherein the epoxy resin is a reaction product of Bisphenol A and epichlorohydrin having molecular weight in the range of from about 340 to about 5,000.

6. A process for forming foundry cores and molds comprising the steps of:

(1) contacting a hot pattern with a free-flowing resin coated sand comprising:

(a) particles of sand coated with from about 1 to about 8%, by weight of the sand, of a phenol-formaldehyde novolak resin;

(b) a curing agent;

(c) from about 2 to about 50%, by weight of the phenol-formaldehyde novolak resin of an epoxy and/or phenoxy resin;

(2) holding the resin coated sand against the hot pattern to bond a portion of the particles of resin coated sand together to form a foundry mold or core of suitable thickness;

(3) removing bonded particles of resin coated sand from bonded particles of sand forming the foundry mold or core;

(4) curing the foundry mold or core, the hot pattern having a temperature of from about 175° C. to 370° C. and (5) removing the foundry mold or core from the pattern.

7. The process in accordance with claim 6, wherein the temperature of the hot pattern is from about 200° C. to about 290° C.

8. The process in accordance with claim 6, wherein said pattern is metal.

9. The process in accordance with claim 6, wherein the phenol-formaldehyde novolak resin is present in amounts ranging from about 1 to about 6% by weight based on the sand.

10. The process in accordance with claim 6, wherein an epoxy resin is employed in the composition, said epoxy resin being the reaction product of Bisphenol A and epichlorohydrin having a molecular weight in the range of from about 340 to about 5,000.

11. A resinous-coated sand comprising:

(a) particles of sand coated with from about 1 to about 8%, by weight of the sand, of a phenol-formaldehyde novolak resin;

(b) a curing agent;

(c) from about 2 to about 50%, by weight, based upon the weight of the phenol-formaldehyde novolak resin of an epoxy resin produced by reaction of bisphenol-A and epichlorohydrin.

* * * * *

UNITED STATES PATENT AND TRADEMARK OFFICE

CERTIFICATE OF CORRECTION

PATENT NO. : 4,113,916

DATED : Sept. 12, 1978

INVENTOR(S) : Robert Simpson Craig

It is certified that error appears in the above-identified patent and that said Letters Patent are hereby corrected as shown below:

In the abstract:

In part (a) after phenol-formaldehyde, delete "morolak" and insert --novolak--

In part (c) after phenol-formaldehyde, delete "morolak" and insert --novolak--

In the specification:

Column 1 line 43, delete "from" and insert --iron--

Column 3 line 3, delete "ether" and insert --other--

Column 4 line 1, delete "suprisingly" and insert --surprisingly--

Column 4 line 26, delete "varables" and insert --variables--

Column 5 line 19, delete "shelve" and insert --shelf--

Column 5 line 22, delete "catalysis" and insert --catalysts--

Column 6 line 15, insert --A-- after the first Resin and in line 16, delete "A"

Column 6 line 28, after run delete "a" and insert --at--

Column 6 line 30, delete "briguets" and insert --briquettes--

UNITED STATES PATENT AND TRADEMARK OFFICE

CERTIFICATE OF CORRECTION

PATENT NO. : 4,113,916

DATED : Sept. 12, 1978

INVENTOR(S) : Robert Simpson Craig

It is certified that error appears in the above-identified patent and that said Letters Patent are hereby corrected as shown below:

In the specification:

Column 7 line 22, in the table delete "Central" and insert --Control--

Column 7 line 30, delete "properities" and insert --properties--

In the Claims:

Column 9 line 15, in claim 6 step (3), after removing delete "bonded" and insert --unbonded--

Column 9 line 20, in claim 6 step (4), delete "370" and insert --320--

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*